US005565653A

United States Patent [19]

Rofidal et al.

[11] Patent Number: 5,565,653

[45] Date of Patent: Oct. 15, 1996

[54] HIGH FREQUENCY TRANSMISSION CABLE

[75] Inventors: Patrick Rofidal, Fumay; Serge Damilo, Charleville-Mezieres, both of France

[73] Assignee: Filotex, Draveil, France

[21] Appl. No.: 302,252

[22] Filed: Sep. 8, 1994

[30] Foreign Application Priority Data

Sep. 9, 1993 [FR] France ..... 93 10732

[51] Int. Cl.[6] ..... H01B 11/02

[52] U.S. Cl. ..... 174/113 R; 174/117 R; 174/117 F; 174/115

[58] Field of Search ..... 174/113 R, 36, 174/117 R, 117 F, 115, 34

[56] References Cited

U.S. PATENT DOCUMENTS

| | | | |
|---|---|---|---|
| 3,673,315 | 6/1972 | Lasley | 174/107 |
| 3,894,172 | 7/1975 | Jachimowicz et al. | 174/34 |
| 4,038,489 | 7/1977 | Stenson et al. | 174/70 R |
| 4,487,997 | 12/1984 | Ditchfield | 174/115 |
| 4,654,476 | 3/1987 | Barnicol-Ottler et al. | 174/116 |
| 4,674,822 | 6/1987 | Hall | 439/399 |
| 4,684,766 | 8/1987 | Tanaka et al. | 174/115 |
| 4,755,629 | 7/1988 | Beggs et al. | 174/34 |
| 4,777,325 | 10/1988 | Siwinski | 174/34 |
| 5,132,488 | 7/1992 | Tessier et al. | 174/34 |
| 5,399,813 | 3/1995 | McNeill et al. | 174/117 F |

FOREIGN PATENT DOCUMENTS

| | | |
|---|---|---|
| 1665605 | 4/1971 | Germany . |
| 3405852A1 | 8/1985 | Germany . |

*Primary Examiner*—Kristine L. Kincaid
*Assistant Examiner*—Chau N. Nguyen
*Attorney, Agent, or Firm*—Sughrue, Mion, Zinn, Macpeak & Seas

[57] ABSTRACT

The high frequency transmission cable comprises insulated conductors assembled together in bundles which are themselves assembled together in at least one unit, and also comprising an outer sheath for overall protection. It further comprises a dielectric rod that is grooved lengthwise for assembling together the bundles in each unit, the grooves of the rod being open via respective slots and serving to hold individual bundles while keeping them apart from one another. The cable is particularly suitable for use as a computer cable.

11 Claims, 1 Drawing Sheet

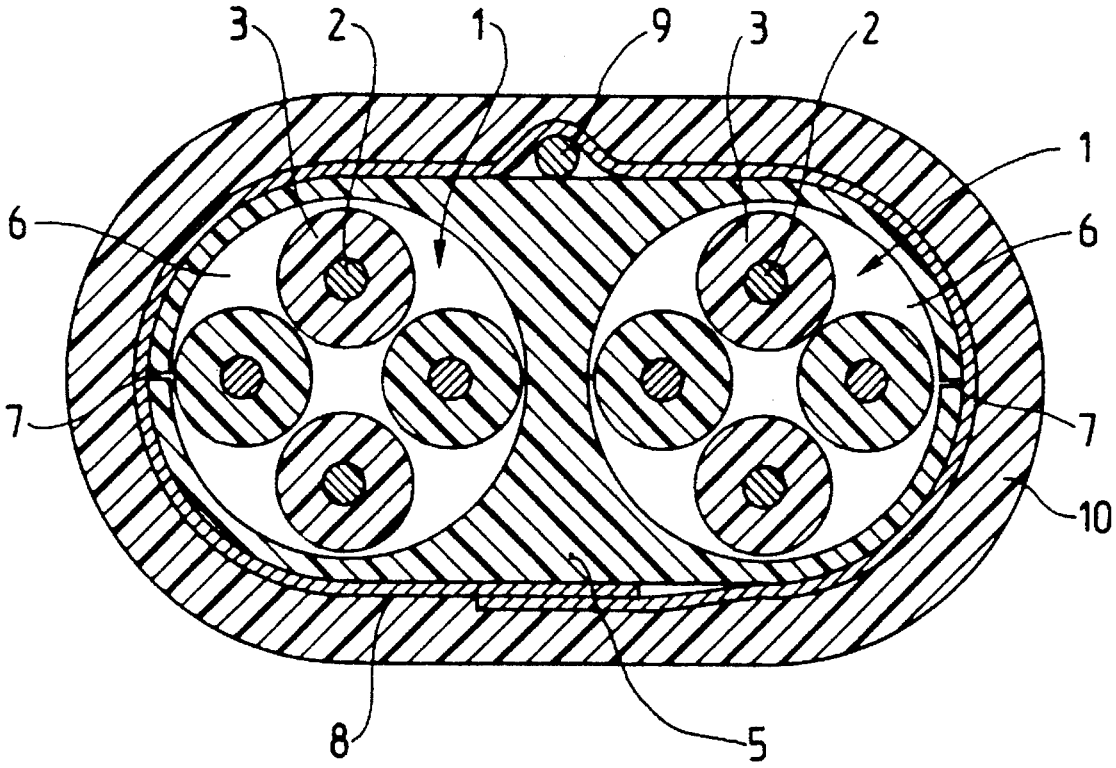
3
2
1
9
3
2
1
6
6
7
7
10
8
5

HIGH FREQUENCY TRANSMISSION CABLE

The present invention relates to a high frequency transmission cable of the type comprising individually insulated electrical conductors that are assembled together in a plurality of bundles which are often protected by screening, and which includes an outer sheath for overall protection.

BACKGROUND OF THE INVENTION

Such cables are used in particular in the field of computing for high frequency data transmission, which may take place at about 100 MHz. Outwardly such cables are often of a flat shape. The bundles of insulated conductors may be in pairs, in triplets, or in quads. They may additionally be assembled together into one or more units. The insulated conductors of the bundles within a given unit are then advantageously assembled together at different pitches in order to build up the different bundles within the unit. Screening then surrounds each unit of the bundle.

In such a cable, each unit may be held together and screened by means of an insulating tape, e.g. made of polyester and having its outside face metallized. The tape is laid lengthwise or helically around the unit made up of bundles and it has overlapping margins. The unit may be made up of bundles having different assembly pitches so as to enable cross-talk between bundles to be reduced, thereby enabling a limit value of about −35 dB at 100 MHz to be achieved, but not any less.

In such a cable, the closeness of the screening to the insulating conductors that it surrounds also gives rise to relatively high values of linear capacitance and of linear attenuation for the cable.

Document WO-A-86/05311 describes a flat computer cable in which the individually insulated conductors are assembled together in pairs that are protected by individual screens, all of said insulated conductors being located in the same plane. In that cable, two insulated conductors that are positioned side by side are assembled together as a pair by a first insulating coating extruded around the two insulated conductors that are thus embedded therein. Each pair is protected by a metal screening tape surrounding it. Protected pairs that are disposed side by side are assembled together by means of a second insulating coating that is extruded around them, and that forms the overall outer protective sheath of the cable.

Advantageously, two opposite grooves are formed in the first coating between the two conductors of the pair concerned and in the second coating between the various pairs it assembles together, so as to facilitate the stripping that is necessary for gaining access to the conductors and for installing a terminal connector on the various pairs of the cable. For the same reasons, the first coating is made of polyvinyl chloride (PVC) that does not adhere to the insulation of the conductors which is made of polyethylene (PE) or of propylene (PP).

Implementing such a cable is relatively lengthy and very difficult. A large number of extrusion operations are required. In particular, after the first coating operation for assembling together the two conductors in each pair, and after the second coating operation for assembling pairs together, it requires accurate relative positions to be enforced between the various conductors in order to satisfy conditions initially defined for the desired electrical characteristics of the cable.

Stripping operations are also lengthy, by choosing a first coating of PVC on the PE or PP that insulates the conductors, the resulting dielectric properties are not as good as those which could have been obtained by using PE or PP or one of their copolymers, but in that case they would adhere very firmly to the insulated conductors which would then become difficult to strip.

In addition, by disposing the conductors in the same plane, the number of possible ways in which the conductors can be assembled together in the cable are limited since the conductors are assembled together in pairs only.

OBJECTS AND SUMMARY OF THE INVENTION

An object of the present invention is to provide a high frequency cable that avoids the above-mentioned known drawbacks of implementation and that enables cross-talk levels on the order of −40 dB to −50 dB to be obtained at 100 MHz.

The present invention provides a high frequency transmission cable comprising individually insulated electric conductors assembled together in a plurality of bundles that are themselves assembled together in at least one unit, together with an overall protective outer sheath, the cable further including a grooved dielectric rod for assembling together the bundles in each unit, the rod being provided with longitudinal grooves each of section adapted to the section of the corresponding one of the bundles and open via a slot to the periphery of the rod, in which the various bundles of the unit concerned are held individually while being kept separate from one another.

Advantageously, the cable may also present at least one of the following additional characteristics:

- said rod is made of a material selected from: polyethylene, propylene, and copolymers thereof;
- said rod is of elliptical right cross-section and includes at least two diametrically opposite grooves both centered on the major axis of the elliptical section, with the respective slots thereof being located at the ends of said major axis;
- said grooves are circular in section, being deformable by opening the slot of each of them, for the purpose of receiving a corresponding bundle each constituted by insulated conductors that are assembled together directly, and of being closed onto the bundles; and
- the cable includes a plurality of rods for assembling bundles together in a corresponding number of units, which rods are disposed and held side by side within said outer sheath.

BRIEF DESCRIPTION OF THE DRAWING

The characteristics and advantages of the present invention appear from the following detailed description of a preferred embodiment shown in the accompanying drawing.

In the drawing, the sole FIGURE is a section view through a high frequency transmission cable of the invention.

MORE DETAILED DESCRIPTION

The cable is flat and comprises two quads 1. Each quad is made up of four solid conductors 2 that are twisted together, in particular copper conductors, each of which is covered in insulation 3, preferably made of PE or of PP.

Both quads are received in a grooved dielectric rod 5 that serves to assemble the two quads together, holding them and keeping them apart. The dielectric rod 5 has two lengthwise grooves 6 for this purpose, each receiving one of the two quads.

Each of the grooves is circular in section, and matches the section of the quads 1. Each groove is open via a narrow slot 7 running along the periphery of the rod, either initially or when the quad is put into place. The slot is of very small or substantially zero width, being a few tenths of a millimeter wide, or more advantageously about a few hundredths of a millimeter wide only, for the purposes of subsequent closure thereof.

The dielectric rod 5 is an extruded section member that is preferably made of polyethylene or of polypropylene. For a cable whose desired shape is flat, the rod is elliptical in section, with its two grooves and their associated slots being centered on the major axis of the ellipse. The rod acts as a separator for holding the two quads and for keeping them apart. Its axial zone between the two grooves has a minimum thickness of at least 0.2 mm and preferably lying in the range of 0.3 mm to 0.5 mm. for insulated conductors having a diameter of about 1.3 mm.

In addition, the cable includes a screen 8 in the form of a tape that extends lengthwise and that has its margins overlapping around the dielectric rod and the two quads assembled together thereby, together with a wire 9 that provides screening continuity which is interposed between the screen 8 and the dielectric rod. The screen may be made of metal or of a dielectric which is metallized and, in particular, has a deposit of aluminum thereon. It serves to keep the slots of the various grooves in the rod it surrounds properly closed.

The overlap of one of the margins of the screen 8 over the other takes place at a point remote from the slots 7 that open out into the grooves. In this example, the overlap takes place on one of the large faces of the dielectric rod 5. The same applies to the location of the screening continuity wire 9 which, in this example, is substantially centered on the opposite large face of the section member.

The above unit comprising two quads protected in the above-specified manner is itself covered by an outer sheath 10 for overall protection. The sheath serves to keep the screen firmly clamped around the rod whose grooves it serves to close. The sheath is extruded directly onto the screen as soon as the screen has been put into place. It may be made of PE or of PP, or preferably of PVC or of any other conventional material for such sheaths.

The above cable can be made quickly and simply. Manufacture is performed on a manufacturing line (not shown) including means for paying out the rod, two sets of spacers that insert themselves into the slots of the grooves in the rod so as to open them by elastic deformation, guide and insertion means for guiding and inserting the two quads into the open grooves of the rod, screening continuity wire guide means for guiding the continuity wire over the rod, means for guiding and installing the screening tape around the rod, and finally a dye for extruding the outer protective sheath.

In a variant (not shown) the rod may be of a section other than elliptical, and it may be made without any peripheral sharp edges. It may include more than two longitudinal grooves, each adapted to the section of the bundle that is to be installed therein, the bundles assembled in the rod being optionally constituted by quads, and/or triplets, and/or pairs. The slots of the various grooves may be relatively large. In which case they are closed by a dielectric gasket that is applied thereto and held in each of them, or by an outer dielectric tape surrounding the rod, or by a screen having a dielectric layer that is preferably of reinforced thickness.

The above rodded cable for holding and separating the bundles of each unit may also be provided without a screen.

In another variant, the cable may include a plurality of rods optionally surrounded by their individual screens, and held together side by side within an outer sheath that is extruded around them.

The cable of the present invention provides the following advantages, in particular:

the level of cross-talk that is obtained is on the order of −40 dB to −50 dB at 100 MHz, with or without the screen;

the shapes of the bundles assembled together within the rod are protected, particularly while the cable is being curved, thereby giving rise to an improvement in uniformity of impedance;

the screen is kept well away from the conductors and it is held closed lengthwise; and the conductors are easily accessible through the slots of the grooved rod once the protective outer sheath has been opened, which sheath may itself be provided with grooves to facilitate opening thereof.

We claim:

1. A high frequency transmission cable comprising individually insulated electric conductors assembled together in a plurality of bundles that are themselves assembled together in a unit, together with an overall protective outer sheath, the cable further including a grooved dielectric rod for assembling together the bundles in the unit, the rod being provided with longitudinal, non-communicating grooves each having a cross-section sized to accommodate a cross-section of a corresponding one of the bundles and each being open via a slot to the periphery of the rod, in which the bundles of the unit are held individually while being kept separate from one another.

2. The cable according to claim 1, wherein said rod is made of a material selected from the group consisting of: polyethylene, propylene, and copolymers thereof.

3. The cable according to claim 1, wherein said rod is of elliptical right cross-section and includes at least two of said diametrically opposite grooves both centered on the major axis of the elliptical section, with the slots thereof being respectively located at the ends of said major axis.

4. The cable according to claim 1, wherein said grooves are circular in section, being deformable by opening the slot of each of them, for the purpose of receiving a corresponding one of said bundles.

5. The cable according to claim 1, wherein said rod has a central zone forming a dielectric spacer between the bundles held in its grooves, and having a minimum thickness lying in the range of 0.3 mm to 0.5 mm.

6. The cable according to claim 1, wherein said slots are narrow, being of substantially zero width in that the width is less than a few tenths of a millimeter.

7. The cable according to claim 1, further including an element for closing the grooves containing said bundles.

8. The cable according to claim 1, wherein the bundles of the unit are constituted by two to four twisted-together conductors that are thus held directly in the grooves.

9. The cable according to claim 1, further including a screen placed around the unit with the edges of the screen overlapping, wherein the screen surrounds said dielectric rod, and the mutually overlapping margins of said screen are offset from the slots.

10. The cable according to claim 1, wherein said rod has a central zone forming a dielectric spacer between the bundles held in its grooves, and having a minimum thickness of not less than 0.2 mm.

11. The cable according to claim 1, wherein said slots are narrow, being of substantially zero width in that a width is on the order of a few hundredths of a millimeter.

* * * * *